US008512265B2

(12) United States Patent
Lev et al.

(10) Patent No.: US 8,512,265 B2
(45) Date of Patent: Aug. 20, 2013

(54) PERCUSSIVE MASSAGER

(75) Inventors: Mordechai Lev, West Bloomfield, MI (US); Sara Robertson, Walled Lake, MI (US)

(73) Assignee: FKA Distributing Co., Commerce Township, MI (US)

( * ) Notice: Subject to any disclaimer, the term of this patent is extended or adjusted under 35 U.S.C. 154(b) by 314 days.

(21) Appl. No.: 12/949,225

(22) Filed: Nov. 18, 2010

(65) Prior Publication Data

US 2011/0118637 A1 May 19, 2011

Related U.S. Application Data

(60) Provisional application No. 61/262,623, filed on Nov. 19, 2009.

(51) Int. Cl.
*A61H 23/00* (2006.01)
*A61H 19/00* (2006.01)

(52) U.S. Cl.
USPC ..... 601/111; 601/107; 601/108; 601/101; 601/103

(58) Field of Classification Search
USPC ..... 601/27, 28, 84, 89, 90, 92–95, 97, 601/98, 100–104, 107, 108, 110–113, 115, 601/134
See application file for complete search history.

(56) References Cited

U.S. PATENT DOCUMENTS 2,413,133 A * 12/1946 Aydelotte ..... 601/89
2,836,174 A * 5/1958 Infanger ..... 601/27
2,964,037 A * 12/1960 Johnston ..... 601/94
3,548,811 A * 12/1970 Wilson ..... 601/111
4,150,668 A * 4/1979 Johnston ..... 601/94
4,513,736 A * 4/1985 Thurber ..... 601/57
4,730,605 A 3/1988 Noble et al.
4,936,292 A * 6/1990 Hidetsugu ..... 601/104
5,065,743 A * 11/1991 Sutherland ..... 601/134
5,716,332 A 2/1998 Noble
6,089,664 A 7/2000 Yoshida
6,165,145 A * 12/2000 Noble ..... 601/111
6,500,135 B2 12/2002 Huang
6,932,779 B2 * 8/2005 Kasai ..... 601/99
7,207,956 B2 * 4/2007 Mizoguchi et al. ..... 601/99

(Continued)

OTHER PUBLICATIONS

International Search Report for corresponding Application No. PCT/US2010/057383, mailed Jan. 19, 2011, 11 pages.

(Continued)

*Primary Examiner* — Justine Yu
*Assistant Examiner* — Michael Tsai
(74) *Attorney, Agent, or Firm* — Brooks Kushman P.C.

(57) ABSTRACT

A percussive massager is provided with a housing, a cushion, a percussive drive unit having a massage head with four spaced apart massage nodes, and a cover surrounding the massager. The nodes diametrically extend outwardly or upwardly from the exterior cushion surface to effect a rhythmic percussion to a user. The cover has at least two apertures through which the nodes protrude, and a flap extending over at least two of the massage nodes. The flap has a fastener to allow for removal of the flap from the cover. A percussive massager is also provided with a motor housing, a motor with a rotary output shaft, an elongated flexible rocker arm pivotally connected to the motor housing, and a massage node connected to an end region of the rocker arm. The flexible rocker arm deflects to provide compliance when the node contacts a massage surface.

14 Claims, 3 Drawing Sheets

(56) References Cited

U.S. PATENT DOCUMENTS

| | | | | |
|---|---|---|---|---|
| 7,322,946 | B2 * | 1/2008 | Lev et al. | 601/15 |
| 2005/0209539 | A1 | 9/2005 | Lev et al. | |
| 2006/0211962 | A1 | 9/2006 | Ferber et al. | |
| 2007/0021695 | A1 | 1/2007 | Wu | |
| 2008/0077061 | A1 | 3/2008 | Dehli | |
| 2008/0262398 | A1 | 10/2008 | Ferber et al. | |

OTHER PUBLICATIONS

International Preliminary Report for corresponding Application No. PCT/US2010/057383, mailed May 31, 2012, 9 pages.

* cited by examiner

PERCUSSIVE MASSAGER

CROSS-REFERENCE TO RELATED APPLICATIONS

This application claims the benefit of U.S. Provisional Application No. 61/262,623, filed Nov. 19, 2009; the disclosure of which is incorporated in its entirety by reference herein.

TECHNICAL FIELD

Various embodiments of the invention relate to percussion massagers.

DETAILED DESCRIPTION

As required, detailed embodiments of the present invention are disclosed herein. It is to be understood, however, that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
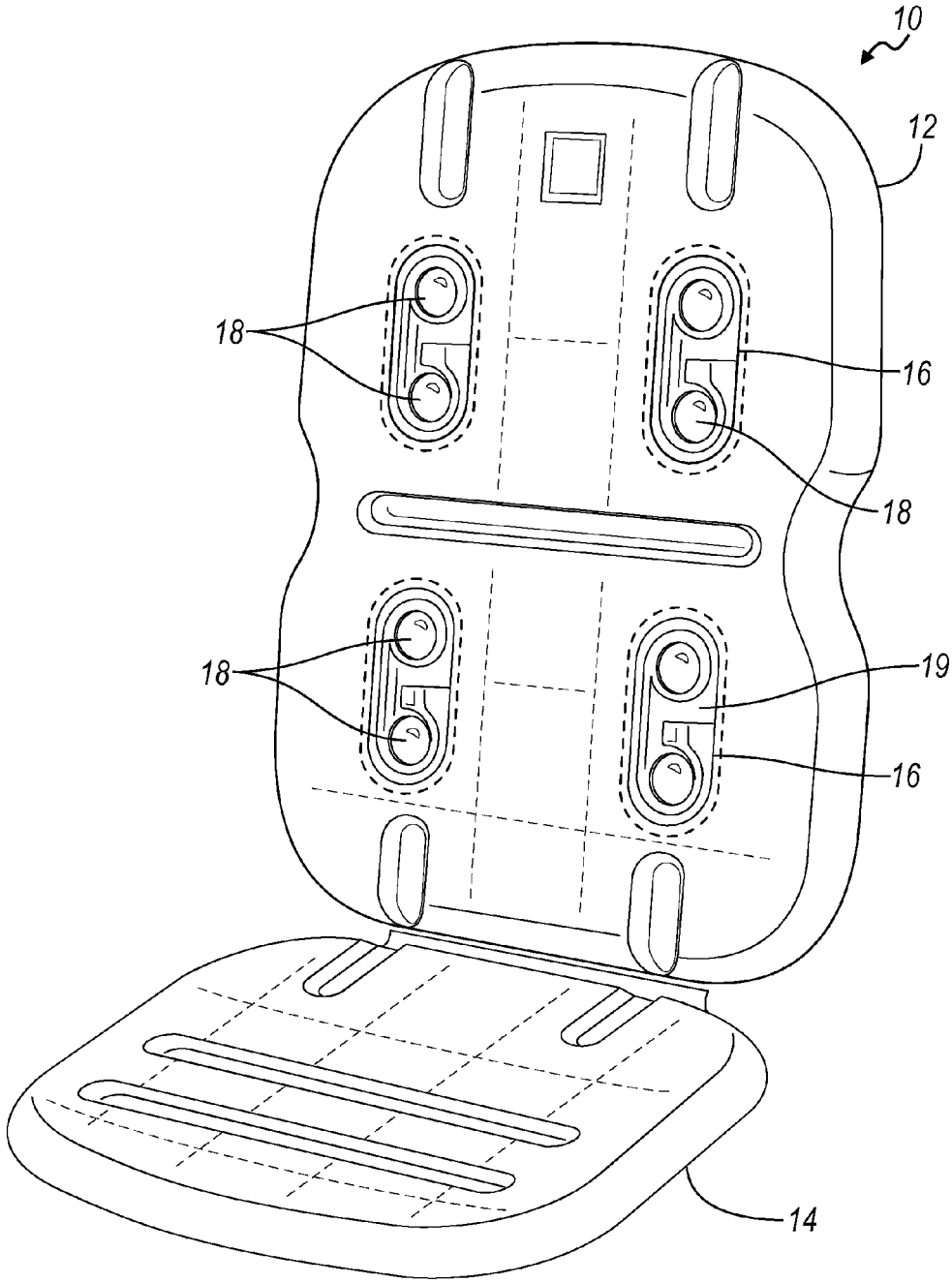
FIG. 1 is a massager having a tapping massage effect according to an embodiment.

FIG. 1 illustrates a percussion massager 10 according to an embodiment. The massager 10 has a backrest portion 12, a seat portion 14, and contains two percussive drive units 16. Each percussive drive unit 16 has four massage nodes 18, with two nodes 18 on a massage head 19. Of course, any number of percussive drive units 16, supporting and driving any number of massage nodes 18, is also contemplated. The percussive drive units 16 are fixed in position with respect to the backrest portion 12. Alternatively, the percussive drive units 16 and massage heads 19 may travel along a carrier within the massage cushion 10.

Figure 2:
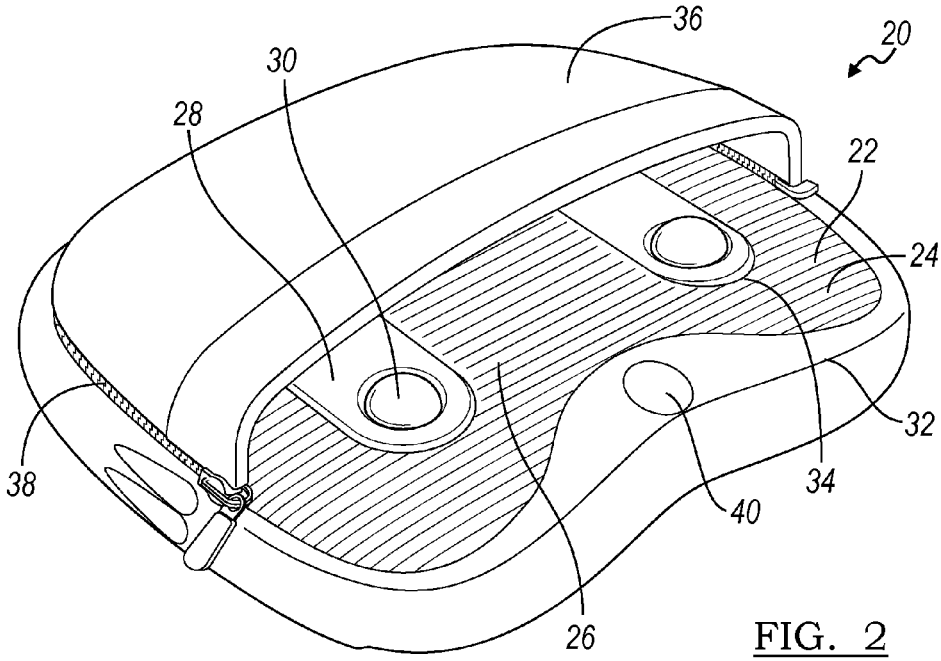
FIG. 2 is a perspective view of a massager having a tapping massage effect according to another embodiment.

FIG. 2 illustrates a percussion massager 20 according to another embodiment. The massager 20 is a foot massager and has a base portion 22 or housing which contains a cushion 24 and a percussive drive unit 26. The percussive drive unit 26 has massage heads 28 supporting massage nodes 30. Although the percussive drive unit 26 is shown as having four massage nodes 30, any number of massage nodes 30 are contemplated for the massager 20. The base portion 22 is covered with a cover 32 made from a fabric, vinyl, leather, or other similar material. The cover 32 has apertures 34 through which the massage nodes 30 protrude through. A flap 36 extends from the cover 32 over at least two of the massage nodes 30. The flap 36 is made from the same material as the cover 32, or alternatively from a different material. The flap has a fastener 38 to attach the flap 36 to the cover 32 and allow for removal and reattachment by a user. The fastener 38 is depicted as a zipper, but a set of snaps, a hook and loop fastener, or other fastener could be employed as is known in the art. The flap 36 provides a pocket for a user to place their feet during the massager operation, which provides a secure place for the feet, as well as additional warmth. A switch 40 is provided on the base portion 22 between two adjacent massage nodes 30, although other locations are contemplated. The switch may be operated through the cover 32.

The massagers 10, 20 of FIGS. 1 and 2, respectively, have a stationary tapping massage head 19, 28 within the massage cushion 10 or the foot massager 20. Alternatively, the tapping massage head 19, 28 may be mounted on a carrier which moves or translates within the massage cushion 10 or foot massager 20. Each massage head 19, 28 has two spaced apart nodes 18, 30 diametrically extending outwardly or upwardly from the exterior cushion surface 12, 24 to effect a rhythmic percussion, or "tap," to the user. The nodes 18, 30 may be paired extending vertically, as shown, or horizontally. In addition to the percussive effect, a vibratory effect may be provided alone or in conjunction with the tapping effect using a vibratory module (not shown). The vibratory module may be connected to the percussive drive unit 16, 26 or the massager housing.

Figure 3:
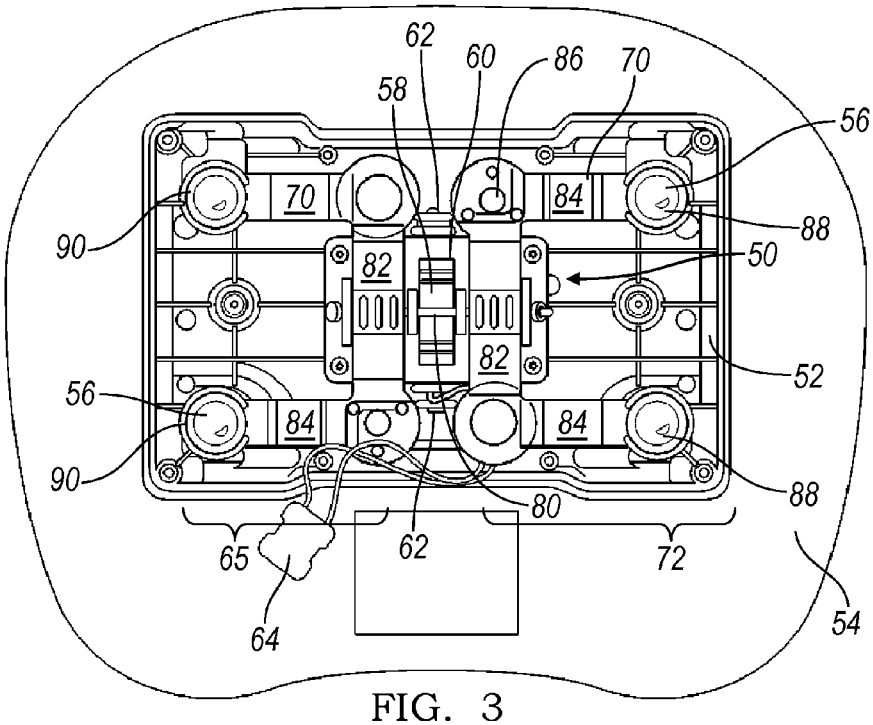
FIG. 3 is a top plan view of the massager of FIG. 2 illustrated partially disassembled with a drive unit according to an embodiment.
Figure 4:
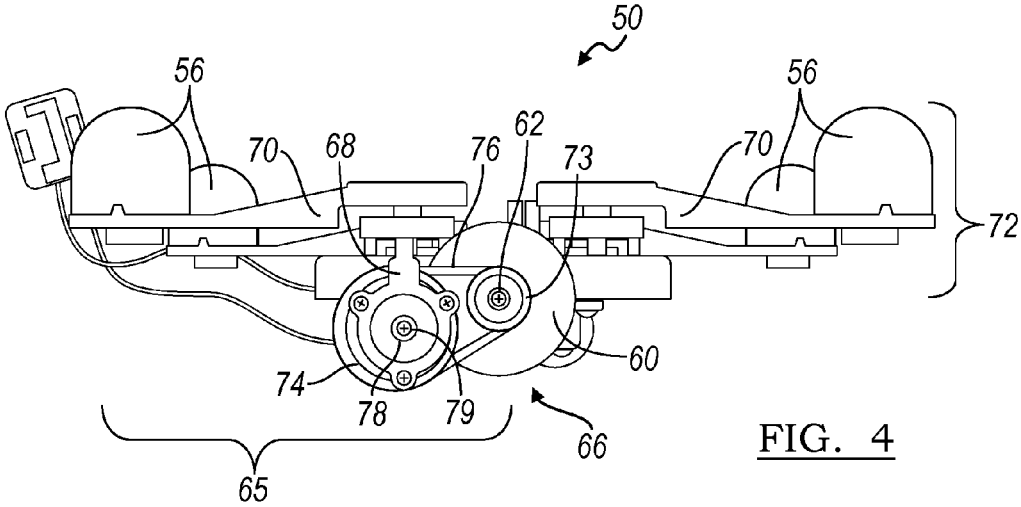
FIG. 4 is a side perspective view of the drive unit of FIG. 3.
Figure 5:
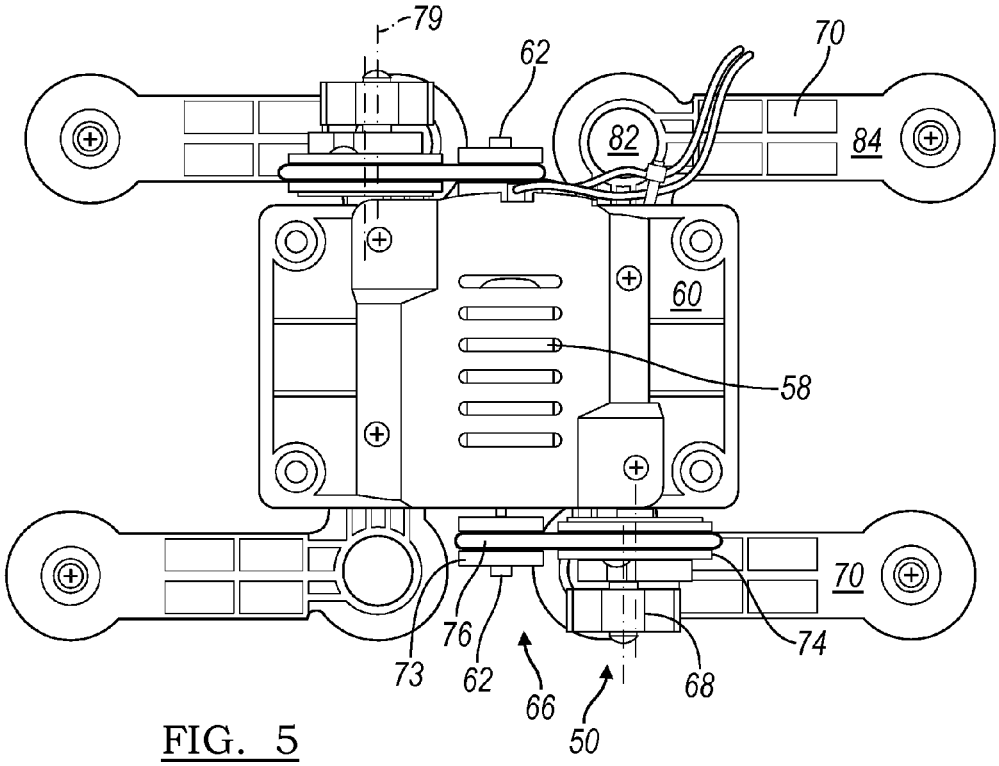
FIG. 5 is a bottom view of the drive unit of FIG. 3.

FIGS. 3-5 illustrate an embodiment of a percussive drive unit 50 for use in the percussion foot massager 20. The percussive drive unit 50 described herein may also be used in the massager 10, or another type of massager, such as a hand-held massager. The percussive drive unit 50 is connected to a housing 52. The housing provides a support structure for both the percussive drive unit 50 and a cushion 54 for the massager 50. The cushion 54 is made from a foam or any other suitable material. The percussive drive unit 50 is connected to and drives four massage nodes 56, which impart a massage effect the body of a user. The massage nodes 56 provide a percussive massage effect, and in one embodiment move asynchronously such that diagonally related nodes 56 act in concert.

The percussive drive unit 50 has a motor 58 supported by a motor housing 60. The motor 58 has two rotary output shafts 62, each extending from an end of the electric motor 58. The electric motor 58 is powered by a battery pack (not shown) or with a power cord assembly (not shown). The electric motor 58 is activated using a switch 64. The switch 64 is an on/off switch, and may additionally include a variable speed function to vary the massage speeds as directed by the user. The switch 64 may be push, sliding, rotating, or other forms of switches as are known in the art.

The percussive drive unit 50 has a first massage assembly 65. The first massage assembly 65 has a belt and pulley system 66 connecting one of the output shafts 62 to a connecting rod 68. The connecting rod 68 drives a rocker arm 70 or massage head, which supports a pair of massage nodes 56.

The massager 50 also has a second massage assembly 72 with a belt and pulley system 66, connecting rod 68, rocker arm 70, and massage nodes 56 connected in a similar manner as described for the first massage assembly 65. Other drive mechanisms for transferring energy and motion from the motor shaft 62 to the rocker arm 70 and massage nodes 56 of the massager 50 are also contemplated as are known in the art.

The belt and pulley system 66 of the first massage assembly 65 has a first pulley 73 connected to the rotary output shaft 62 of the motor 58 such that the first pulley 73 rotates as the output shaft 62 rotates. A second pulley 74 is connected to the motor housing 60 using a bearing assembly or the like such that the pulley 74 may rotate with respect to the housing 60. A belt 76 connects the first pulley 72 and the second pulley 74. The first and second pulleys 72, 74 have a groove along their outer surface which acts to retain the belt 76 in place. As the motor 58 operates, the output shaft 62 turns, which rotates the first pulley 72. The first pulley 72 engages the belt 76, which in turn engages and rotates the second pulley 74.

The connecting rod 68 is connected to the second pulley 74 using a rotary bearing assembly 78 at an off-axis location 79 of the second pulley 74. This eccentric attachment at location 79 causes the proximal end of the connecting rod 68 to travel in a circular path, causing the distal end connected to the rocker arm 70 to oscillate.

The rocker arm 70 is pivotally connected to the motor housing 60 using a pin 80. In one embodiment, both rocker arms 70 of the first and second massage assemblies 65, 72 are connected using the same pin 80 along a common axis. In other embodiments, two pins, or other pivotal fasteners may be used. The pin 80 is oriented generally perpendicular to the rotary output shaft 62 of the motor 56. This allows for each rocker arm 70 to be positioned to a respective side of the motor 58, and provides for packaging the massage assemblies 65, 72 with the motor 58, and its two output shafts 62.

In one embodiment, the rocker arm 70 is elongated and flexible. The rocker arm 70 may be fabricated from plastic or other material which allows for deflection of the rocker arm 70 to provide compliance when a node 56 connected to the rocker arm 70 contacts a massage surface. The deflection of the rocker arm 70 may also act as a dampening system to reduce impact loads transferred to the drive unit 50 when the massage node 56 contacts a massage surface. The rocker arm 70 has a base portion 82 and a leg 84 extending from each end region of the base portion 82. A massage node 56 is connected to the end region of a leg 84 of the rocker arm 70. The base portion 82 is positioned generally parallel to the rotary output shaft 62 of the motor 58. The legs 84 are positioned generally perpendicular to the base portion 82. The connecting rod 68 is connected to the rocker arm 70 at a junction between the base portion 82 and one of the legs 84. A gasket 86 or other fitting is used in the connection of the connecting rod 68 to the rocker arm 70.

In one embodiment, the leg 84 is tapered. The leg 84 decreases in thickness such that the thickness of the leg 84 adjacent to the base portion 82 is greater than the thickness of the leg 84 adjacent to the massage node 56. The variable thickness of the leg 84 allows for further deflection and flexibility of the leg 84 and the rocker arm 70 when contacting a massage surface. The base portion 82 may also have variable thicknesses in some embodiments.

As the connecting rod 68 oscillates, the rocker arm 70 and nodes 56 oscillate about the pivotal axis of the rocker arm and about the pin 80. The connecting rods 68 are connected to the second pulley 74 of each massage assembly 65, 72 such that the rocker arms 70, and in turn the nodes 56, to oscillate asynchronously, where opposing or diagonally positioned nodes 56 on adjacent rocker arms 70 act together to impart a massage effect to the user at approximately the same time. One of the nodes 56 from the first pair of massage nodes 88 on a rocker arm 70 is extended, while an adjacent massage node on the second pair of massage nodes 90 on the other rocker arm 70 is retracted.

In another embodiment, the nodes 56 may oscillate synchronously, with the nodes 56 on adjacent rocker arms 70 on the same transverse side of the pivotal connection 80 moving together and interacting with a body part of a user at approximately the same time.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, features of various implementing embodiments may be combined to form further embodiments of the invention.

What is claimed:

1. A percussive massager comprising:

a motor housing;

a motor disposed within the motor housing, the motor having a rotary output shaft extending from an end of the motor;

an elongated flexible rocker arm pivotally connected to the motor housing, wherein the flexible rocker arm is a dampening system for the massager;

a massage node connected to an end region of the rocker arm;

wherein the flexible rocker arm is configured to deflect to provide compliance when the node contacts a massage surface and to reduce impact loads transferred to the drive unit when the massage node contacts a massage surface; wherein the elongated flexible rocker arm has a base portion and a leg extending from an end region of the base portion; wherein the node is positioned to extend generally perpendicular to the leg; wherein the leg is positioned generally perpendicular to the base; and wherein the base portion is positioned generally parallel to the rotary output shaft of the motor.

2. The percussive massage of claim 1 wherein the leg is tapered such that the thickness of the leg adjacent to the base portion is greater than the thickness of the leg adjacent to the massage node.

3. The percussive massager of claim 1 further comprising a connecting rod driven by the motor, wherein the connecting rod is connected to the rocker arm at a junction of the base portion and the leg.

4. The percussive massage of claim 3 wherein the massage node is connected to the leg spaced apart from the base portion.

5. The percussive massager of claim 3 further comprising a belt and pulley system connecting the motor output shaft and the connecting rod, the belt and pulley system having a first pulley connected to the rotary output shaft of the motor, a second pulley rotatably connected to the motor housing and spaced apart from the first pulley, and a belt connecting the first and second pulleys.

6. The percussive massager of claim 5 wherein the connecting rod is connected to the second pulley at an off-axis location of the second pulley.

7. A percussive massager comprising:

a motor housing;

a motor disposed within the motor housing, the motor having a rotary output shaft extending from opposing ends of the motor;

a first massage assembly driven by one end of the output shaft, the first massage assembly having a first rocker arm pivotally connected to the motor housing with a pin, and a first pair of massage nodes, each massage node connected to a respective end region of the rocker arm;

a second massage assembly driven by the other end of the output shaft, the second massage assembly having a second rocker arm pivotally connected to the motor housing with the pin, and a second pair of massage nodes, each massage node connected to a respective end region of the second rocker arm;

wherein the pin is positioned generally perpendicular to the rotary output shaft, and each rocker arm is offset to a respective side of the motor; wherein each rocker arm has a base portion and two legs, each leg extending from a respective end of the base portion and positioned generally perpendicular to the base portion; and wherein the base portion is positioned generally parallel to the rotary output shaft of the motor.

8. The percussive massager of claim 7 wherein the first massage assembly has a first belt and pulley system connected to one end of the rotary output shaft and a first connecting rod, the first connecting rod connected to the first rocker arm; and wherein the second massage assembly has a second belt and pulley system connected to the other end of the rotary output shaft and a second connecting rod, the second connecting rod connected to the second rocker arm.

9. The percussive massager of claim 8 wherein the first connecting rod is connected to a pulley of the first belt and pulley system at an eccentric attachment location of the pulley; and wherein second connecting rod is connected to a pulley of the second belt and pulley system at an eccentric attachment location of the pulley.

10. The percussive massager of claim 9 further comprising a first rotary bearing positioned at the eccentric attachment location between the first connecting rod and the pulley of the first belt and pulley system; and a second rotary bearing positioned at the eccentric attachment location between the second connecting rod and the pulley of the second belt and pulley system.

11. The percussive massager of claim 10 wherein the pulley of the first belt and pulley system is axially spaced apart from the pulley of the second belt and pulley system.

12. The percussive massager of claim 7 wherein one of the nodes of the first pair of massage nodes is extended when an adjacent massage node on the second pair of massage nodes is retracted.

13. The percussive massager of claim 7 further comprising:

a cushion partially surrounding and supported by the motor housing, wherein the massage nodes diametrically extend outwardly or upwardly past an exterior surface of the cushion to effect a rhythmic percussion to a user; and a cover surrounding the massager, the cover having at least two apertures through which the nodes protrude and a flap extending over at least two of the massage nodes, the flap having a fastener to allow for removal of the flap from the cover.

14. The percussive massager of claim 7 further comprising a switch positioned on the housing and between two adjacent massage nodes, the switch being actuated through the cover.

* * * * *